US005791508A

United States Patent [19]

Arnould

[11] Patent Number: 5,791,508

[45] Date of Patent: Aug. 11, 1998

[54] OPENING DEVICE ON THE LID OF A PACK FOR LIQUIDS

[75] Inventor: Doninique Arnould, Oron-la-Ville, Switzerland

[73] Assignee: Tetra Laval Holdings & Finance S.A., Pully, Switzerland

[21] Appl. No.: 135,026

[22] Filed: Oct. 12, 1993

[30] Foreign Application Priority Data

Oct. 13, 1992 [CH] Switzerland ..... 03 197/92-4

[51] Int. Cl.[6] ..... B65D 43/24; B65D 51/18

[52] U.S. Cl. ..... 220/254; 220/335; 220/337

[58] Field of Search ..... 220/254, 259, 220/335, 339, 337, 334

[56] References Cited

U.S. PATENT DOCUMENTS

| | | | |
|---|---|---|---|
| 3,372,832 | 3/1968 | Yeater et al. | 220/254 |
| 3,675,812 | 7/1972 | Foster | 220/337 |
| 3,737,066 | 6/1973 | Ames | 220/254 |
| 4,103,804 | 8/1978 | Fournier et al. | 220/281 |
| 4,144,985 | 3/1979 | Kinslow | 220/254 |
| 4,361,250 | 11/1982 | Foster | 220/266 |
| 4,538,731 | 9/1985 | Cillario | 220/254 X |
| 4,858,793 | 8/1989 | Stone | 220/259 X |
| 4,874,103 | 10/1989 | Quisenberry et al. | 220/254 |
| 4,949,865 | 8/1990 | Turner | 220/254 X |
| 5,125,525 | 6/1992 | Tucker | 220/254 |
| 5,203,467 | 4/1993 | Tucker | 220/254 |

*Primary Examiner*—Allan N. Shoap
*Assistant Examiner*—Niki M. Kopsidas
*Attorney, Agent, or Firm*—Joseph G. Nauman

[57] ABSTRACT

The opening device comprises a closure flap (7) which is pivotable about a hinge (2), so that a pouring opening (4) is able to be opened and closed again. The edge (5) of the pouring opening (4) is elastically deformable. A projection (12) is provided in the form of a device for keeping open the closure flap (7) in such a way that the projection (12) is pulled over the edge (5) of the pouring opening (4) during the opening operation, and then bears on the edge and keeps the closure flap (7) open. To close it again, the projection can be pressed by slight pressure over the edge of the pouring opening. The new proposed design of the device for keeping a flap open advantageously prevents the device from becoming damaged in the closed condition, possibly if packs provided with the opening device are stacked. In addition, the device for keeping flaps open is very simple to manufacture.

12 Claims, 2 Drawing Sheets

1
2
3
4
5
6
7
8
9
10
11
12
18
a

OPENING DEVICE ON THE LID OF A PACK FOR LIQUIDS

FIELD OF THE INVENTION

The invention relates to an opening device on the lid of a pack for liquids, with which a pouring opening is capable of being opened and closed again by way of a closure flap by the closure flap being pivotally and non-detachably hinged by means of a hinge to the end, oppositely disposed to the pouring side, of the pouring opening, wherein at least the edge of the pouring opening is an elastically deformable material.

BACKGROUND OF THE INVENTION

Many types of packs for liquids are known, wherein, for example, a pack is formed from a tube of plastics coated paper which has a lid and a bottom at its ends, wherein the lid is made of plastics material without supporting material, i.e. without paper and is injected onto the upper edge of the paper tube. The lid of the known pack is substantially flat and has a pouring opening extending substantially from the centre of the lid to an outer edge, which opening is disposed in a so-called second inner plane which is disposed a slight distance, i.e. 2 to 10 mm, preferably 5 mm, inside the so-called first outer plane which forms the outer surface of the lid of the pack.

A further development to the lid with the opening device of this known pack has been made in such a way that the closure flap of the opening device of the kind mentioned in the introduction remains open at a specific angle, after opening, during pouring. The engagement means for keeping open the known closure flap are disposed in the region or the hinge on the side oppositely disposed to the tip of the closure flap, and the engagement means have a retaining bead which projects upwardly substantially vertically from the flap, and arranged at a spacing from this is a substantially vertically downwardly projecting lug which is arranged on a reinforcing rib in the central region of the lid.

Improvements to the retaining device would be worthwhile because it is very difficult to manufacture the retaining bead, to keep a spacing between it and the lug, and to design the hinge and a reinforcing rib which is oriented in a specific way and other means. Expensive injection moulding tools are also required. In addition, the known retaining device can be damaged just as a result of stacking the known packs.

SUMMARY OF THE INVENTION

The aim of the invention is therefore to provide the device for keeping open the closure flap in the opening position with an opening device of the kind mentioned in the introduction, in such a way that this device for keeping open the closure flap is easy to manufacture and to design and in such a way that no damage can occur in the closed condition.

According to the invention this problem is solved in that a projection from the bottom edge of the closure flap is arranged in downwardly projecting fashion in such a way that, on opening, it can be drawn above the edge of the pouring opening and rests on the edge of the pouring opening, with the closure flap being kept open. In the known way, it is a simple matter to arrange a projection by the use of injection moulding tools. The device, according to the invention, for keeping open the closure flap is therefore easy to manufacture and design, since the injection moulding tools are not complicated by the device according to the invention for keeping the closure flap open.

In the sense of the invention, the word "bottom" is used to denote a substantially vertical direction, which,—extending from the lid of the pack for liquids—is to be imagined as being in the direction of the inside of the pack. According to the invention, said projection is disposed from the closure flap towards the inside of the pack. It projects downwardly from the closure flap in such a way that in the closed condition with the closure flap lying parallel to the main plane of the lid, preferably in a horizontal position, it cannot be seen from the outside. The projection is thus disposed directly adjacent to the edge of the pouring opening.

A plastics material for injection-moulding a lid with the opening device and closure flap is an elastically deformable material which is such that the device according to the invention for keeping the closure flap open does not hinder actuation of the new opening device. During opening, the user pulls up the closure flap by a handle, wherein the closure flap is pivoted up over the hinge. The hinge can be a simple weakening line or a fold edge extending over the entire width of the upper side of the closure flap in a straight line, approximately in the central region of the lid. The orientation of the hinge is preferably vertical to the longitudinal central direction of the pouring opening, it being supposed that this extends from the region of the hinge to the pouring spout or tip of the pouring opening. On pouring, the jet of liquid also flows in the latterly mentioned longitudinal direction of the pouring opening.

If, on opening, the closure flap is pivoted up about the hinge, the projection for the device for keeping the closure flap open can be pulled up over the edge of the pouring opening. In other words, the projection touches the edge of the pouring opening and can possibly even deform it. As a result of the capacity of the material of the edge of the pouring device to be deformed, after the closure flap has been completely opened, the edge adopts its previous condition, so that when the handle Is let go the projection rests on the edge of the pouring device. The device for keeping the closure flap open has therefore fully performed its function.

With this opening device, in addition to the new device for keeping the closure flap open, it is also quite a simple matter to re-close the pack. The user is able to bring the closure flap from the opening position into the closure position by slight pressure, and therein the projection can be pressed within the edge of the pouring opening in a similar way during closure. Once the closure flap is back in the closure position, the projection is inside the pack, namely directly below the closure flap, so that it cannot be damaged from the outside.

It is favourable according to the invention if the projection is positioned on the edge of the closure flap so that it is inclined outwardly from its centre. The tube of the pack has a substantially vertically increasing longitudinal central axis, opposite which the projection is positioned inclinedly, in accordance with the feature mentioned latterly. The projection at the edge of the closure flap thus forms an angle with the tube axis of the pack which is in the range of 0° to 30°, preferably 5° to 20°, and about 15° with one particularly preferred embodiment. This means that the projection bears on the edge of the pouring opening in a particularly expedient way and can be moved during both opening and closure movements, without any damage occurring, by slight deformation of the parts which slide on one another.

The invention is also further characterised in that arranged on each side of the hinge and in the vicinity thereof is at least one pin-like projection. It has proved particularly expedient and reliable to design the projection in the form of a pin. It is also possible to design the projection in the form of a bead, needle, a raised semi-sphere or an edge. It is also expedient if the projection is arranged in the vicinity of the hinge, in the similar way already provided with the known retaining means with two parts which hook inside each other (retaining bead and lug). In order to provide a means which very reliably keeps the closure flap in its open position, it is, however, particularly expedient if a projection of this kind is arranged on either side of the hinge, since the entire width of the closure flap is then held in the defined position. According to this teaching, the straight hinge described in the introduction and extending over the width of the closure flap has one side at the start of the width and the other side at the end of the line which extends over the closure flap. According to this teaching, one projection therefore lies at the one end of the straight elongate hinge, and the other projection is disposed at the opposite end.

Various tests have shown that a particularly favourable selection of the features according to the invention is such that the edge of the pouring opening has greater elasticity than the projection. The projection and the fixing edge, disposed on the closure flap, for the projection are admittedly made of the plastics material from which the lid as a whole is injection moulded. However, the design of the parts on the side of the projection is such that when the parts touch and slide on one another, namely the projection and the edge of the pouring opening whenever the closure flap is brought into the opening position or vice versa from the latter into the closure position, the edge of the pouring opening is deformed to a greater extent than the projection. This means that the opening device can be properly re-closed since the projection is pressed particularly favourably, and in such a way that it retains its shape, along the edge of the pouring opening. With one preferred embodiment, this is produced in a particularly simple way if the edge, disposed in the region of the hinge, of the pouring opening is thinner than the other substantially U-shaped to substantially V-shaped edge of the pouring device, as viewed from the top onto it and vertically onto its plane. The front edge of the pouring opening, particularly in the region of the front pouring tip at the spout end of the pouring opening is thus thicker and more rigid than at the back, i.e. than in the region of the hinge. It is very easy to design this edge portion so that it is thinner to the rear than at the front by inclining the injection moulding tools. The thinner edge portion can then be more easily bent, as will be readily appreciated.

It is also advantageous according to the invention if the edge of the pouring opening is oriented towards the inside of the pack, at least in the region of the hinge, towards the plane of the pouring opening. It has already been mentioned hereinabove that according to the invention it is possible for the projection to be positioned inclinedly outwardly. Alternatively, or preferably, it is, however, also possible to position the edge of the pouring opening inclinedly at a similar angle to the axis of the tube. This provides particularly good stabilisation when the pack is being kept open, since the projection which can preferably be shaped like a horn then comes to lie horizontally to the support face if the closure flap is disposed in the open position. Despite this very stable position for keeping the closure flap open, re-closure is also very simple since the pin-like or horn-like projection can easily be pressed along this inclinedly positioned edge of the pouring opening.

The opening device according to the invention with the afore-described features is particularly expedient, if, according to the invention, the lid is substantially flat and shaped from plastics material. A particularly good material for this is a thermoplastics material, as known per se.

Further advantages, features and possible applications of the present invention will emerge from the following description in conjunction with the accompanying drawings which reproduce a preferred embodiment of the invention, wherein:

DESCRIPTION OF THE PREFERRED EMBODIMENT

Figures 1, 2:
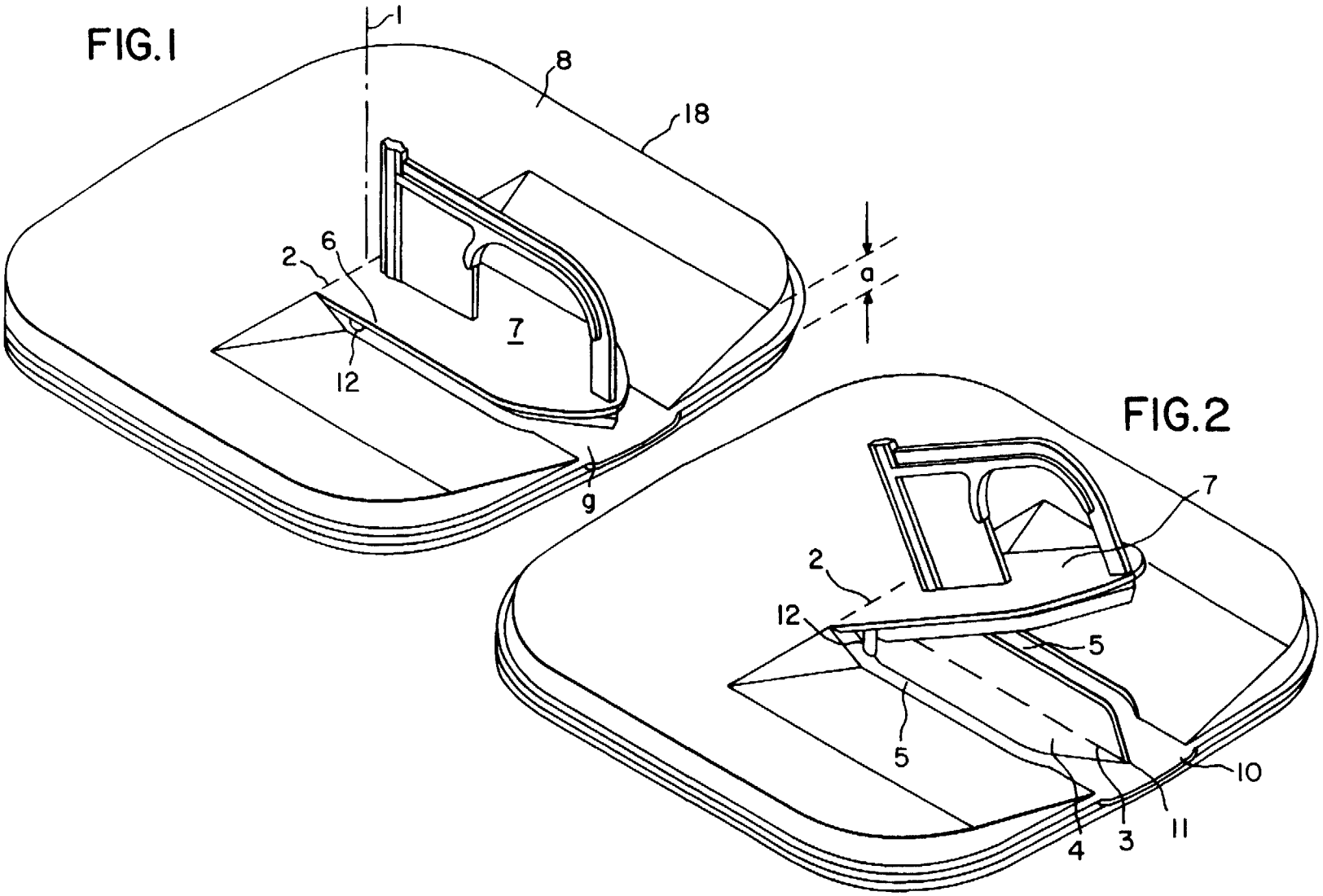
FIG. 1 is a plan view in perspective of the lid of a pack for liquids.
FIG. 2 is the same view as in FIG. 1, wherein, however, the closure flap is shown in the position where it is kept open.

The substantially flat lid is arranged perpendiuclarly to the longitudinal centre axis 1 of the tube of the pack, not shown, wherein the axis 1 of the tube is marked by dotted and dashed lines in FIG. 1 and is shown perpendicularly by the dashed line of the hinge 2. However, it also stands perpendicularly on the longitudinal central axis 3, likewise marked by broken lines, of the pouring opening 4. FIG. 2, in particular, is the plan view of a somewhat ship-shaped edge 5 of the pouring opening 4 which is arranged in parallel relationship under the edge 6 of the closure flap 7.

Simply for the sake of clarity it shall be stated that the lid is surrounded by a rim 18 and as shown has an outer first plane 8 and a second inner plane 9 which is arranged in displaced relationship to the first plane at a spacing a therefrom, downwardly in the direction of the tube axis 1, in which second inner plane the pouring edge 10 lies which is disposed close to the tip 11 of the pouring opening 4 on the pouring side.

Figure 3:
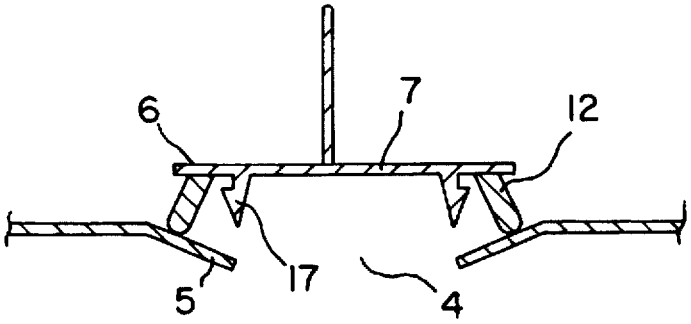
FIG. 3 is an enlarged cross-sectional view of the closure flap and surrounding structure.

Shown in the region of the hinge 2, on either side of it, is a horn-shaped or pin-shaped projection 12 on the lower edge 6 of the closure flap 7. When the closure flap 7 is in the closed position, as shown in FIG. 1, this pin-shaped projection 12 is almost invisible in the direction of the interior of the pack. The pin-shaped projection 12 is positioned at an angle of 10° relative to the tube axis 1 and is vertical to the edge 5, also positioned inclinedly, of the pouring opening 4 in the opening position in FIG. 2. Thus, the edge 5 of the pouring opening 4 supports the closure flap 7 which is in the opening position by way of the pin-like projection 12, as shown in FIG. 3. After opening, the user can pour out the contents calmly, without the risk of the closure flap 7 closing.

Figure 4:
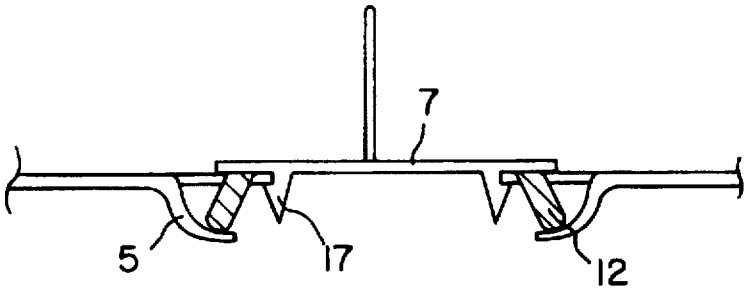
FIG. 4 is a view similar to FIG. 3 showing the flap closed.
Figure 5:
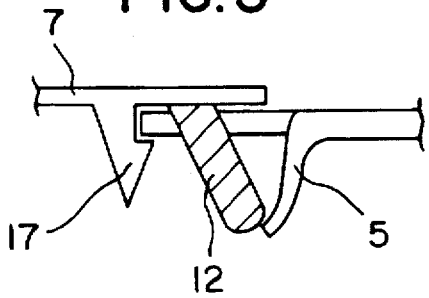
FIG. 5 is an enlarged view showing details of a projection on the closure flap engaging the edge of the pouring opening.

After the contents have been poured out, if so desired, the user can press the closure flap 7 onto the pouring opening 4 in such a way that the re-closure position is reached, as seen in FIG. 4. During this closure movement, the closure flap 7 pivots about the hinge 2 in the clockwise direction, if a view is taken in the direction of the straight hinge, i.e. from left to right in the drawings shown. During this closure movement the pin-like projection 12 is substantially held in its position, whilst the edge 5 of the pouring opening 4 is deformed in the region of the hinge 2, so that the projection 12 can be pushed against the flexible edge 5, and the move through the pouring opening as shown in FIGS. 4 and 5. The latch member 17 engages under the flexible edge 5 on either side of the projections and along the underside of the pouring opening. After opening, the edge 5 of the closure opening 4 again assumes its manufactured structure and is once again in a position to support the closure flap 7 in the position shown in FIG. 2 where the flap is kept open.

These movements and functions of the device for keeping the flap open are obviously repeated several times until the contents are emptied from the non-returnable pack. The pivotable parts are in a good stable condition relative to each other, and the closure flap 7 cannot be damaged in the closed condition, since the projection 12 projects inwardly, rather than outwardly (FIG. 5).

I claim:

1. A lid for a pack for liquids, said lid having a generally planar area (8) surrounded by a rim (18) and a pouring opening (4) in said lid, said pouring opening defined by a flexible edge (5) displaced below said planar area, said pouring opening having a base at the center of said lid and a pouring edge tip (11) adjacent to said rim, a closure flap (7) having upper and lower surfaces and said flap being shaped corresponding to and of greater area than said pouring opening to rest against and cover said flexible edge, a hinge (2) connecting said flap (7) at said base of said pouring opening, a latch member (17) on said lower surface of said flap facing said pouring opening and shaped to enter said pouring opening and to latch under said flexible edge for holding said flap in closed position, at least a pair of projections (12) extending from said lower face of said flap beyond said latch member and in position to contact said flexible edge, said projections being sufficiently rigid as to bend a portion of said flexible edge and thereby to extend past said flexible edge when said flap is closed and latched, said projections providing a support for said flap in a raised open position when said latch member is released and said flap is raised away from said pouring opening.

2. An lid according to claim 1, said projections are pin-like and are located on either side of said hinge.

3. A lid according to claim 1, characterized in that the edge (5) of the pouring opening (4) has greater elasticity than the projection (12).

4. A lid according to claim 1, characterized in that edge (5) of the pouring opening (4), at least in the region of hinge (2), is inclined towards the inside of the pack opposite the plane of the pouring opening (4).

5. A lid according to claim 1, characterized in that said lid is substantially flat and is made from plastics material.

6. A lid according to claim 1, wherein the projection (12) and the edge (6) of the closure flap (7) form an angle with the central axis (1) of the pack, said angle being in the range of 0° to 30°.

7. A lid according to claim 6, wherein said angle is in the range of 5°–20°.

8. A lid according to claim 7, wherein said angle is approximately 15°.

9. A lid according to claim 8, wherein said projection is in the form of a semi-spherical bead.

10. A lid according to claim 1, wherein said edge (5) of said pouring opening (4) is thinner in the region adjacent said hinge (2).

11. A lid according to claim 1, wherein said edge (5) of said pouring opening (4) is thicker and more rigid at the tip (11) of said pouring opening (4) than at said hinge (2).

12. An integral opening device incorporated into a molded plastic lid for liquid containing package, the lid having a rim (18) and a pouring opening (4) defined by a thin flexible tapered edge (5) extending from a tip (11) adjacent said rim to a location adjacent the center of said lid, a closure flap (7) having a top and a bottom dimensioned to cover said pouring opening and an integral hinge (2) attaching said flap to the end of said pouring opening opposite said tip, a latch member (17) on said lower surface of said flap facing said pouring opening and shaped to enter said pouring opening and to latch under said flexible edge for holding said flap in closed position;

characterized by projections (12) extending downward from said bottom of said closure flap toward said flexible tapered edge of said pouring opening so as to rest on said edge of said pouring opening and support said flap in an open position, said edge (5) of the pouring opening (4), at least in the region of said hinge (2), being inclined towards the inside of the pack opposite the plane of the pouring opening (4), said projections being sufficiently rigid as to flex portions of said flexible edge and pass through said pouring opening when said latch member is engaged to hold said flap closed.

* * * * *